United States Patent [19]

de Nora et al.

[11] Patent Number: 4,545,886

[45] Date of Patent: Oct. 8, 1985

[54] NARROW GAP ELECTROLYSIS CELLS

[75] Inventors: Vittorio de Nora, Nassau, The Bahamas; Henri B. Beer, Heide-Kalmthout, Belgium

[73] Assignee: ELTECH Systems Corporation, Boca Raton, Fla.

[21] Appl. No.: 506,436

[22] PCT Filed: Oct. 26, 1982

[86] PCT No.: PCT/EP82/00236

§ 371 Date: Jun. 21, 1983

§ 102(e) Date: Jun. 21, 1983

[87] PCT Pub. No.: WO83/01630

PCT Pub. Date: May 11, 1983

[51] Int. Cl.[4] ..... C25B 9/00; C25B 11/02; C25B 11/08; C25B 11/10

[52] U.S. Cl. ..... 204/252; 204/265; 204/283; 204/284; 204/290 R; 204/290 F; 204/291; 204/295; 204/296

[58] Field of Search ..... 204/252, 283, 284, 290 R, 204/290 F, 295, 296, 265, 282, 291

[56] References Cited

U.S. PATENT DOCUMENTS

| | | | |
|---|---|---|---|
| 4,331,523 | 5/1982 | Kawasaki | 204/129 |
| 4,448,662 | 5/1984 | Du Bois et al. | 204/283 |
| 4,457,822 | 7/1984 | Asano et al. | 204/283 |
| 4,465,580 | 8/1984 | Kasuya | 204/290 R |

FOREIGN PATENT DOCUMENTS

| | | | |
|---|---|---|---|
| 31660 | 7/1981 | European Pat. Off. | 204/252 |

*Primary Examiner*—Donald R. Valentine
*Attorney, Agent, or Firm*—Arthur S. Collins

[57] ABSTRACT

A narrow gap electrolysis cell has anode and cathode compartments divided by an ionically-permeable separator, such as an ion-exchange membrane or a fibrous diaphragm, and a current feeder grid in electrical contact with a surface-activated particulate electrocatalytic material carried on a face of the separator. The particulate material has cores of a corrosion-resistant material preferably valve metal particles or sponge, or compounds thereof, as well as asbestos fibres and fibres of ion-exchange copolymeric perfluorocarbons, coated with a platinum-group metal catalyst in metal or oxide form. The surface-activated particles may be at least partly carried by a flexible electronically conductive foil between the current feeder grid and the separator.

21 Claims, 1 Drawing Figure

NARROW GAP ELECTROLYSIS CELLS

TECHNICAL FIELD

The invention relates to narrow gap electrolysis cells of the type having anode and cathode compartments divided by an ionically-permeable separator, and a current-feeder grid in electrical contact with particulate electrocatalytic material carried on a face of the separator.

BACKGROUND ART

In conventional electrolysis cells having separate anode and cathode compartments, the anode, intervening separator and cathode are spaced apart from each other to allow for gas release and electrolyte circulation. In order to reduce the cell voltage, it has already been proposed to bring the electrodes into contact with the separator to form a narrow gap cell. Thus, in such a narrow gap electrolysis cell the passage of current from one electrode to an opposite electrode takes place only through the ionically-permeable separator which typically will be an ionic selective and ionic conductive membrane. Current flows from the surface of one separator to the surface of the separator of an adjoining cell only by electronic conductivity (i.e. via the current-feeder grids and their associated connections or bipolar separators), then flows ionically to the opposite surface of the separator.

However, problems have been encountered with these narrow gap cells, such as the loss of active electrode surface due to masking by the separator and the consequent need for large quantities of particulate electrocatalytic material to make up an effective electrode. When it is desired to use platinum-group metals or platinum-group metal oxides as the active material, the cost of these electrodes becomes prohibitive. Consequently, conventional membrane and diaphragm electrolysis cells with electrodes spaced from the separator still remain competitive despite their voltage penalty.

The state-of-the-art relating to narrow gap electrolysis cells is illustrated by the following U.S. Patents:

U.S. Pat. No. 3,870,616
U.S. Pat. No. 4,056,452
U.S. Pat. No. 4,191,618
U.S. Pat. No. 4,210,512
U.S. Pat. No. 4,214,969
U.S. Pat. No. 4,236,993
U.S. Pat. No. 4,253,922
U.S. Pat. No. 3,992,271
U.S. Pat. No. 4,057,479
U.S. Pat. No. 4,209,368
U.S. Pat. No. 4,212,714
U.S. Pat. No. 4,217,401
U.S. Pat. No. 4,247,376
U.S. Pat. No. 4,253,924
U.S. Pat. No. 4,039,409
U.S. Pat. No. 4,177,118
U.S. Pat. No. 4,210,501
U.S. Pat. No. 4,224,121
U.S. Pat. No. 4,250,013
U.S. Pat. No. 4,293,394

Examples of the particulate electrocatalysts that have been proposed for narrow gap electrolysis cells are:

ANODE

The platinum-group metals, i.e. platinum, palladium, iridium, rhodium, ruthenium, osmium, in particular in the form of blacks such as platinum black and palladium black.

Alloys of the platinum-group metals, in particular platinum/iridium alloys containing 5 to 50% by weight of iridium and platinum/ruthenium alloys containing 5 to 60% by weight of ruthenium, as well as alloys with other metals such as the valve metals titanium, tantalum, niobium and zirconium.

Oxides of the platinum-group metals, especially reduced oxides, and mixtures of these oxides as well as stabilized mixtures of these oxides with oxides of the valve metals titanium, tantalum, niobium, zirconium, hafnium, vanadium and tungsten and oxides of other metals. This includes ternary "alloy" of oxides such as titanium/ruthenium/iridium oxides and tantalum/ruthenium/iridium oxides.

Carbides, nitrides, borides, silicides and sulphides of platinum-group metals.

"Intermetallic" compounds of platinum-group metals and of nonprecious metals including pyrochlores, delafossites, spinels, perovskites, bronzes, tungsten bronzes, silicides, nitrides, carbides and borides.

Graphite particles are frequently recommended as an extender for admixture with some of the abovementioned particulate anode catalysts.

CATHODE

The platinum-group metals, in particular blacks such as platinum black and palladium black, and iron, cobalt, nickel, copper, silver, gold, manganese, steel, stainless steel, and graphite, as well as alloys such as platinum-/iridium, platinum/nickel, platinum/palladium, platinum/gold, nickel alloys, iron alloys and other compositions of nickel with molybdenum, tantalum, tungsten, titanium and niobium.

Oriented particles with an embedded non-porous part of iron, steel, cobalt, nickel, copper, platinum, iridium, osmium, palladium, rhodium, ruthenium and graphite having a protruding low hydrogen overvoltage porous part.

Oxides of the platinum-group metals, in particular reduced oxides such as oxides of Pt, Pt-Ir and Pt-Ru.

Active borides, nitrides, silicides and carbides especially of platinum-group metals but also titanium diboride.

Phthalocyanines of Group VIII metals, perovskites, tungsten, bronzes, spinels, delafossites and pyrochlores.

DISCLOSURE OF INVENTION

The invention concerns a narrow gap electrolysis cell in which the particulate electrocatalytic material carried on a face of the separator comprises particles having cores of corrosion-resistant non-precious material with at least one platinum-group metal electrocatalyst in metal and/or oxide form and which preferably is solely or principally on the outer surfaces of the particles.

The terms "particulate" and "particles" are meant to designate fragmentary solids of any desired shape, e.g. in the form of powders, granules, pellets, fibres, flakes, and of any suitable size so that they can be carried by a face of the narrow gap cell separator and form an effective electrocatalytic material. Typically, pellets and flakes will not exceed about 3 mm in any one direction, although it is possible to employ fibres up to 1 mm diameter and 50 mm length. When powders are employed, the usual size range will correspond to a mesh size of 20–200 ASTM.

The particles provided according to the invention comprise cores of a non-precious material (that is, specifically excluding precious metals such as the platinum-group metals, gold and silver and alloys including them, as well as oxides or other compounds of these precious metals) which is resistant to corrosion in the environment in which the materials are to be used in the narrow gap electrolysis cell. Suitable core materials include the so-called "valve metals" or "film-forming metals" titanium, zirconium, niobium, tantalum, tungsten and silicon as well as other metals such as nickel, chromium, manganese and stainless steel, and alloys of two or more of the aforementioned metals or their alloys with other non-precious metals. The core materials may be in the metallic state, or compounds such as oxides and other oxycompounds, hydrides, carbides, nitrides and borides of one or more of the aforementioned metals and possibly other metals, specific examples being $TiO_2$, $Ta_2O_5$, $ZrO_2$, $AL_2O_3$, $SiO_2$, $TiB_2$, $MgO.Al_2O_3$ (magnesium aluminate), $ZrSiO_4$, $(CaO)_2SiO_2$, calcium aluminate, $CaTiO_3$, $CaO.ZrO_2$, aluminosilicates (as disclosed in UK Patent Specification No. 1402414), other ternary and complex oxides including attapulgite, kaolinite, asbestos, mica, cordierite and bentonite, boron nitride, silicon nitride. One particularly interesting core material, for some applications, is asbestos of the grades commonly used to form diaphragms for chlor-alkali electrolysis. Other possible core materials are polymeric materials (including ion-exchange copolymeric perfluorocarbons) and glassy or vitreous carbon. All of these core materials may be non-porous or substantially non-porous to the extent that the active electrocatalytic material including the platinum-group metal electrocatalyst will remain predominantly and preferably exclusively at the surface of the core and will not penetrate into and remain inside the core at sites where the electrocatalyst would be ineffective for the electrochemical reaction occurring at the electrode of the narrow gap cell. The degree of porosity permitted will thus depend to a certain extent on the process used for application of the electrocatalyst. Generally speaking only a surface porosity of the particles will be preferred and the central part of the core may be fully impermeable.

Finely divided active carbon, carbon blacks and finely divided graphite which all have a highly microporous structure and consist of agglomerates of microparticles, and which have been used heretofore as catalyst supports or extenders, are not suitable as a core material within the context of the present invention because they tend to absorb and are impregnated by the applied catalyst solutions and resulting catalyst throughout the microporous structure, rather than serving as a core which is coated. Furthermore, the finely divided carbon materials have an insufficient corrosion resistance in the environment of most electrolysis cells and are subject to excessive wear and corrosion when used in the anodes of chlor-alkali cells.

Nevertheless, if it is desired to use particle cores such as asbestos fibres which are quite porous, the coating procedure may for example be carried out with a very viscous coating solution so that the platinum-group metal electrocatalyst does not penetrate deeply into the pores. Alternatively, such porous particle cores may be submitted to a preliminary treatment such as surface-coating them to provide an external shell of a suitable non-precious material which blocks up the external pores. In this manner, the particles are rendered substantially non-porous prior to application of the platinum-group metal electrocatalyst. On the other hand, porous titanium sponge and other valve metal sponges have given good results, and are very advantageous from a cost standpoint compared to powders of the same metals.

Also, in the case of non-conductive or poorly conductive particle cores, it may be advantageous to provide a surface coating of a conductive or semi-conductive non-precious material which is also resistant to corrosion in the electrolyte, thus providing a composite particle core.

On the surface of these cores of the particles is provided at least one platinum-group metal electrocatalyst. This may be one of the platinum-group metals: platinum, palladium, rhodium, iridium, ruthenium and osmium, or their oxides including binary oxides, ternary oxides and other complex oxycompounds. The platinum-group metal electrocatalyst may if desired be mixed, alloyed or compounded with other metals or their compounds or may be dispersed in a suitable binding material including polymeric materials, advantageously electronically conducting polymers.

In one preferred embodiment, the particles comprise a core of valve metal having an integral surface film of a compound (usually the oxide) of the valve metal incorporating the platinum-group metal electrocatalyst. Such an integral surface film is formed by applying to the film-forming metal particles at least one layer of a solution of at least one thermodecomposable compound of a platinum-group metal, drying and heating each applied layer to decompose the compound(s), wherein the applied solution contains an agent which attacks the film-forming metal surface of the particles and converts metal from the surface into ions which are converted into oxide (or another compound) of the film-forming metal during the heating step, the concentration of said agent and of the platinum-group metal compound(s) in the solution and the number of applied layers being such that during the heating of each layer including the last one the decomposed electrocatalyst is incorporated fully in the surface film formed on the particles. Thus, the electrocatalyst is contained in the surface film grown up from the core of the particles.

The nature of the film-forming metal compound of the integral surface film will naturally depend on the atmosphere used for the heating step. The heating may conveniently be carried out in air in which case the film consists of film-forming metal oxide incorporating the platinum-group metal and/or oxide thereof, possibly in the form of a mixed oxide. In a similar manner, heating in hydrogen at a temperature of from about 250° to about 500° C., typically about 400° C. leads to formation of a film-forming metal hydride film. Films of film-forming metal boride, nitride and carbide can be formed by heating in boron, nitrogen or carbon-containing atmospheres. For example, nitrides can be formed by heating in a dry atmosphere of ammonium chloride at temperatures from about 350° C. to 450° C. or in dry ammonia at temperatures from about 400° C. to 900° C. In ammonia, nitride formation in the lower temperature range of about 400°–600° C. is particularly favoured when using particles of alloys such as titanium containing about 0.5% molybdenum or about 6% of chromium or vanadium. Carbides can be formed be heating in some organic atmospheres or in carbon monoxide at about 700°–1000° C. or in an atmosphere containing very finely powdered coal. It is also possible to form mixed or complex compounds with the film-forming metal, e.g. titanium oxychloride. When a non-oxidizing atmosphere is used, the platinum-group metal compound will generally be converted to the metal, integrated in the film-forming metal compound, possibly an intermetallic compound between the platinum-group and film-forming metals.

The surface film formed from the film-forming metal core incorporates one or more platinum-group metal electrocatalysts, preferably iridium, rhodium, palladium and/or ruthenium, as metal or as a compound, usually the oxide or a partially oxidized compound which may be incorporated in the surface film as a mixed film-forming metal/platinum-group metal oxide when the heating is carried out in air or in an oxidizing atmosphere.

The method of manufacture may involve the application of a very dilute acidic solution, i.e. one which contains a small quantity of a thermodecomposable platinum-group metal compound that during decomposition and simultaneous formation of the surface film of film-forming metal compound will be fully absorbed by this surface film, this dilute solution containing generally about 1-15 g/l of iridium, rhodium, palladium and/or ruthenium (as metal).

The solution used will typically include a solvent such as isopropyl alcohol or alternatively an aqueous solvent, an acid (notably HCl, HBr, HI or HF) or another agent (e.g. NaF) which attacks the film-forming metal and converts metal from the core into ions which are converted into the compound of the film-forming metal during the subsequent heat treatment, and one or more thermodecomposable salts of iridium, rhodium, palladium and/or ruthenium. The action of the acid or other agent which attacks or corrodes the film-forming metal core and promotes the formation of the surface film during the subsequent heat treatment is important when it is desired to form such an integral surface film; without a sufficient quantity of a suitable agent producing this effect, formation of the surface film of the film-forming metal would be substantially hindered or inhibited.

Typically, the agent attacking the film-forming metal core will be hydrochloric acid, and the molar ratio of the amount of agent to the iridium, rhodium, palladium and/or ruthenium compound in the paint solution will be 1:1 to 100:1, preferably between 3:1 to 30:1.

The dilute acidic solution used preferably only includes a thermodecomposable platinum-group metal compound (i.e. of iridium, rhodium, ruthenium, platinum, palladium and/or osmium), since a film-forming metal oxide component is provided by the surface film grown on the particle, when the heating is carried out in air. Often, ruthenium, platinum, palladium and osmium compounds are only used in combination with iridium and/or rhodium compounds, but they can also be used alone. However, the dilute paint may also include small amounts of other components such as gold, silver, tin, chromium, cobalt, antimony, molybdenum, iron, nickel, manganese, tungsten, vanadium, titanium, tantalum, zirconium, niobium, bismuth, lanthanum, tellurium, phosphorous, boron, beryllium, sodium, lithium, calcium, strontium, lead and copper compounds and mixtures thereof. If any small quantity of a film-forming metal compound is used it will preferably be a different metal to the film-forming metal substrate so as to contribute to doping of the surface film. When such additives are included in the dilute solution composition, they will of course be in an amount compatible with the small amount of the main platinum-group metal electrocatalyst, so that all of the main electrocatalyst and additive is incorporated in the surface film of film-forming metal compound. These platinum-group metal compounds and other metal compounds may be thermodecomposable to form the metal or the oxide, but in neither case is it necessary to proceed to full decomposition. For example, surfaces prepared from partially decomposed iridium chloride containing up to about 5% by weight of the original chlorine, have shown excellent properties.

Conveniently, the solution will be applied by immersion of the particles in the solution, followed by drying and heating to decompose the platinum-group metal compounds. This procedure may be repeated several times, although it has been found that in some instances a single treatment is sufficient. For the drying step, it is preferred to use a two-stage drying for example 15 minutes at 50°-70° C., followed by 30 minutes or more at 120° C., or even a three-stage drying at 50°-70° C., 140° C. and 180° C. in order to ensure that all of the solvent is driven off. When large quantities of powder are treated, the drying step will generally be prolonged. Also, instead of immersion in a solution, the particles may be suspended in a fluidized bed and sprayed with the solution.

Instead of forming an integral activated surface film on particles of a valve or film-forming metal as described above, in another embodiment the particles are coated with a codeposited mixed-oxide coating of at least one platinum-group metal oxide and at least one other oxide advantageously a valve metal oxide. This would typically be a coating of a ruthenium dioxide-titanium dioxide mixed crystal or solid solution formed by the in situ thermal decomposition of compounds of the component metals into the mixed oxide according to the teaching of U.S. Pat. No. 3,632,498, appropriately modified for application of the coating to a particulate material instead of to the usual electrode bodies such as grids, rods, tubes, plates and expanded meshes. Thus, application of the coating solution will be achieved by immersion of the particles or spraying a fluidized bed of particles and special care must be taken for drying which is usually accomplished in at least two separate stages to drive off the solvent, prior to the heating to decompose the active compounds of the coating material. When valve metal particles are used, there is a risk of explosion due to the reactivity of the powdered valve metals as compared to large bodies, and the following special precautions are recommended: dilution of the coating solution; very slow drying in several stages to ensure drying off of all solvent so that the particles are perfectly dry before the baking step; preferably drying in an inert or reducing atmosphere; and initiation of the baking in an inert or reducing atmosphere.

In contrast to the previously described procedure for forming an integral activated surface film on the particles, the coating procedures will produce a separate outer coating on the particles above the surface film of the particle cores. However, it is understood that it can be advantageous to combine both procedures, i.e. firstly, provide an integral activated surface film on the valve metal particle cores, as a barrier or surface layer, then apply an electrocatalytic outer coating containing the platinum-group metal electrocatalyst e.g. as a mixed oxide on top of this barrier layer. This will be a preferred procedure when a mixed oxide electrocatalytic coating is to be applied to valve metal particles, in view of the reactivity of the valve metal particles (especially finely-divided powders) in the presence of the relatively concentrated coating solutions used for these coatings and the baking conditions used e.g. in air at about 450°-500° C. For such particles, the pretreatment forms an activated surface film of a compound of the valve metal which reduces the reactivity of the particles so that concentrated coating solutions can then be used with baking at elevated temperatures in air, without a risk of explosion. However, for particles of other less reactive materials, e.g. valve metal compounds, a coating containing a platinum-group metal oxide can be applied by the thermal decomposition route without the need for such a surface pretreatment.

In another advantageous embodiment, the particles are coated with an electrically conducting insoluble polymer matrix in which the platinum-group metal electrocatalyst is finely dispersed, both the polymer matrix and the electrocatalyst being formed in situ on the particle cores by the application of a coating solution containing at least one thermodecomposable compound of a platinum-group metal and an organic precursor which can be thermally converted to the electrically conducting insoluble polymer, drying and heating, as taught in published European Patent Application No. 0062951. As before, drying will preferably be carried out in several stages to drive off all solvent (usually an organic solvent). The organic precursor used may consist of any suitable soluble polymer which can be thermally activated so as to undergo a structural change by extensive cross-linking and cyclization to form aromatic or heteroaromatic rings, so as to be able to form a substantially continuous planar semi-conducting polymer structure. Suitable materials can be chosen from polyacrylonitrile (PAN); poly-p-phenylene, polyacrylamide and other derivatives of polyacrylic acid; aromatic polymers, such as aromatic polyamides, aromatic polyesters, polysulfones, aromatic polysulphides, epoxy, phenoxy, and alkyd resins containing aromatic building blocks; polyphenylenes and polyphenylene oxides; polyacenaphthylene; heteroaromatic polymers such as polyvinyl pyridine, polyvinylpyrrolidone and polytetrahydrofurane; prepolymers which are convertible to heteroaromatic polymers, such as polybenzoxyzoles and polybenzimidazopyrrolones; and polymers containing adamantane (especially the above prepolymers, containing adamantane units).

The above described types of surface-activated particulate electrocatalytic material are carried on a face of the narrow gap cell separator and a wide variety of separators, hydraulically permeable and impermeable, organic and inorganic, ion selective and non-selective, are useful in the present invention depending upon the electrolytic process to be carried out and attendant considerations.

One general class of separators is hydraulically impervious but selectively permeable by various ions, typically the ion exchange membranes, including anion, cation, and mixed exchangers. Another class of separators is essentially non-selective, for example, some ceramic separators. On the other hand, materials may have mixed properties, such as asbestos which is itself both hydraulically permeable and somewhat ion selective. Separators are also contemplated where selectivity to certain ions is altered by known means to reduce break migration of product ions, which migration would reduce current efficiency.

One particularly useful class of separators is ion exchange membranes, preferably cation exchange membranes. These will be chosen from the materials known to those skilled in the electrochemical art which are resistant to the environment in which they will be employed. Typical are the sulfonated materials based upon styrene/divinylbenzene backbones. Preferred, especially where extreme conditions are to be expected, are those based upon the perfluorovinyl ethers bearing carboxylic and/or sulfonic acid exchange groups, such as the sulfonated ion exchange membranes more particularly described in U.S. Pat. Nos. 3,041,317, 3,282,875 and 3,624,053 and the carboxylated exchangers described in U.S. Pat. No. 4,123,336 and Japanese Publication No. 53(78)44427.

Such separators may be rendered more selective, i.e. resistant to back-migration of product ions, by known methods, e.g. provision of an aminated cathode-facing surface layer to prevent transport of hydroxyl ions to the anolyte or provision of a thin cathode-facing surface layer of high equivalent weight copolymer, again to decrease back migration. See, for example, U.S. Pat. Nos. 3,976,549 and 4,026,783.

Another class of separators is the conventional asbestos material, typically used in the production of chlorine and caustic or in water electrolysis. More recently, asbestos has been modified so that the resultant separator is a mixture of asbestos and certain polymers, usually fluorinated polymers such as polytetrafluoroethylene, which have been treated to fuse the asbestos and polymer together in a discontinuous fashion. See, for example, South African Pat. No. 74/0315. Asbestos diaphragms may also be rendered more ion selective by various techniques. For example, a hydraulically impervious surface layer of a cation exchanger may be provided (see U.S. Pat. No. 4,036,728) or the asbestos may be impregnated with a cation exchanger while remaining porous (see U.S. Pat. No. 3,853,720).

The invention also applies to inorganic ceramic separators which are essentially porous frits of e.g. zirconia, alumina, etc. as described for example in U.S. Pat. No. 4,119,503. Depending upon the materials of construction, these ceramics may be conductive or, more usually, nonconductive. Preferably, at least one surface of such ceramic separators will be made conductive.

The surface-activated particles are carried on one side of the chosen separator and in many instances advantageously on both sides. By the term "carried on", it is intended to encompass both the instance where the surface-activated particles are applied against the separator surface after formation of the separator, and those cases where the surface-activated particles are actually incorporated into the separator during its formation. Thus, the surface-activated particles may be incorporated into the surface of an ion-exchange membrane by various techniques such as cold pressing or hot pressing into a polymerized membrane or one which is partly polymerized or partly cross-linked. This can be done using a press or by rolling. One technique is to blend the surface-activated particulate electrocatalyst with polytetrafluoroethylene particles or with a mixture of powdered graphite with about 15 to 30% polytetrafluoroethylene particles, place the mixture in a mould and apply heat until the mixture is sintered into a decal which is subsequently bonded to and embedded in the surface of a membrane by the application of pressure and heat. In many instances, it will be preferred to use surface-activated particles which are substantially harder than the material of the separator (membrane or diaphragm) so that they can be pressed into the separator surface.

When the separator is fibrous, for example a diaphragm of asbestos, asbestos bonded with polymers, or of thermoplastic fibres, one convenient production technique is to apply a suspension of the fibres possibly with added polymers by means of vacuum to a porous support (often a porous cathode can) followed by appropriate heating to sinter any polymer present. The surface-activated particulate material can conveniently be applied during a last stage of this vacuum deposition procedure prior to or after sintering of polymers. The particulate material applied as a slurry may be a powder or the like which is incorporated into the pores of the diaphragm, or fibres of dimensions compatible with those forming the diaphragm so that the surface-activated fibres form an outside layer of a composite diaphragm. This is very advantageous for retrofitting existing diaphragm cells which previously operated with an anode diaphragm gap, and converting them to narrow gap cell. This can be done by employing an expandable anode of the type described in U.S. Pat. No. 3,674,676 adjusted so that when the anode structure is expanded the foraminous anode surface, in this instance acting as an anode current feeder grid, presses against the surface-activated particulate material carried by or forming the diaphragm surface. Thus, the surface-activated particulate material, especially fibres, forming an activated anode surface region of the diaphragm will not only provide a great active surface for the anodic gas-evolving reaction, but will also provide for excellent escape of the evolved gas which may be facilitated by the configuration of the foraminate current-feeder grid surface.

In order to facilitate electrolyte diffusion and product release and recovery, the current-feeder grid in electrical contact with the surface-activated particulate material carried on the face of the separator will be foraminous in nature, usually in the form of an expanded metal network or metal screen. Contact with the separator may be achieved by physically pressing the grid against the separator to the point of penetration of the electrocatalyst-containing surface of the separator in some instances. To facilitate such penetration, the grid may be designed such that points of metal extend substantially perpendicularly from the surface facing the separator. The actual nature of the grid chosen will be dictated by a variety of considerations such as chemical and mechanical resistance to the electrolyte and products of electrolysis and by the electrocatalytic properties required to achieve the desired reaction. Typically, for the anode side, the grids will be of a valve metal, especially titanium or tantalum, advantageously coated with an electrocatalytically active material, especially a platinum-group metal oxide or material containing a platinum-group metal oxide. See, for example, U.S. Pat. Nos. 3,632,498, 3,711,385 and 3,776,834. If cathodic, the grids may be of iron, nickel, or nickel-coated iron.

Since it is only necessary for the current collector grid to remain conductive and it is not necessary or desirable for a substantial part of the anodic reaction to take place at the grid surface, it is very advantageous when using a valve metal grid to activate the surface to form a conductive integral surface film of a compound of the film-forming metal incorporating a relatively small quantity of a platinum-group metal electrocatalyst as metal or oxide. Such a surface film can be formed in a similar manner to the previously-described treatment for the surface activation of a valve metal powders, except that the dilute activation solution can conveniently be applied by brush or by spraying. Also with the grid substrate, it will be convenient to apply several layers of the solution with drying and heating each time to build up a surface film containing a relatively small amount of the catalyst, typically about 0.2 to about 2 $g/m^2$ of projected area of the grid-like surface. This surface treatment will preferably be preceded by a strong etching of the valve metal base to provide a very rough surface which will improve the contact between the activated surface film of the current feeder grid and the surface-activated particulate material carried by the separator.

In applications where it is considered very undesirable for the current collector grid to participate in the electrochemical reaction, the current collector grid can be coated with a corrosion-resistant conductive material having a high overvoltage for the desired reaction whereas the surface coating material on the particles has a low overvoltage for the desired reaction. For instance, the grid could be coated with platinum, rhodium or palladium metal which have a high chlorine discharge overpotential, and the particle surface electrocatalyst can be based on ruthenium and/or iridium oxides which have a very low chlorine discharge overpotential.

Conversely, in cell designs where separation of the current feeder grid from the separator surface carrying the surface-activated powder could cause a significant drop in performance if the grid remains inactive, it is possible to coat the grid and the particles with the same or a very similar electrocatalytic material so that both the grid surface and the activated powder participate in the reaction and, in places where the grid may move out of contact with the powder, the reaction continues to take place on the grid surface. A typical example of this would be a current collector grid formed of expanded titanium in contact with titanium particles, both grid and particles being coated with the same electrocatalytic coating such as a codeposited ruthenium dioxide-titanium dioxide mixed crystal, or advantageously, an integral activated surface film (as previously described) top-coated with a separate coating such as a codeposited ruthenium dioxide-titanium dioxide mixed crystal.

When the current-feeder grid is in the form of an expanded metal sheet with relatively large openings or is in the form of ribs spaced apart from one another, it is advantageous to place a flexible, porous electronically conductive foil between the relatively rigid grid with relatively large openings and the separator. Such a flexible porous foil or fine mesh may be made of any suitable material such as a conductive polymer or a metal e.g. nickel for the cathode side or, for the anode side, valve metals surface-activated with an integral film of the valve metal oxide or another compound incorporating a small quantity of a platinum-group metal electrocatalyst, as previously described for the current feeder grid surface. This flexible foil or fine mesh may simply act to improve the contact with the surface-activated particulate material incorporated in the separator surface. However, in many instances it will be advantageous for some or all of the surface-activated powdered material to be carried by the flexible conductive foil which is then sandwiched between the current feeder grid and the separator. For example, the surface-activated particulate material can be embedded or cast in a conductive polymer film or can be affixed to one or both sides of a porous metal foil by the use of a conductive binder, especially conductive polymers, or by flame-spraying. When the particulate material is cast in a polymer film or coating, pore formers may also be included to provide a desired porosity for the composite material.

In one particular embodiment of narrow gap cell according to the invention the anode side of the separator carries the surface-activated particles in contact with the current-feeder grid, the cathode side of the separator is in contact with an oxygen-reducing cathode, and the cathode compartment includes means for supplying an oxygen-containing gas to the oxygen cathode. In such an oxygen cathode, water and the ionic species migrating through the separator (e.g. sodium ions) meet with oxygen supplied on the cathode side in the presence of the cathode electrocatalyst to form the desired product (e.g. NaOH) at a low voltage, as compared to more conventional reactions wherein, for example, hydrogen is evolved at the cathode. See, for example, U.S. Pat. No. 3,926,769. In this embodiment, a means is employed to supply oxygen or oxygen-containing gas under pressure to the porous cathode. Typically, this may be accomplished by providing, instead of the usual liquid containing catholyte compartment, a compartment adjacent the cathode to which is supplied the oxygen-containing gas under pressure. Thus, the product will form at the three-phase interface between oxygen, the migrating species, and the electrocatalyst and be "flushed" from the porous cathode by the migrating water. The product will then be swept down the face of the cathode and may be collected at the bottom of the compartment.

Such an oxygen cathode may be integral with the separator, e.g. by rendering the separator porous on at least the cathode side and impregnating said porous side with the catalyst. Alternatively, the oxygen cathode may be laminated to one side of the separator. In this instance, for example, the oxygen cathode will be formed from one or more polymers loaded on one side with an appropriate electrocatalyst. This polymeric oxygen cathode may then be laminated to the separator by the application of heat. Further, the oxygen cathode may be merely physically held in contact with the separator, an option often chosen if the oxygen cathode is a combination of sintered metal and polymer of sintered metal alone.

The narrow gap electrolysis cells of the present invention will find utility in a variety of processes. Exemplary are the electrolysis of sodium chloride to produce chlorine, hydrogen, and caustic or, employing an oxygen-reducing cathode, chlorine and caustic only; the electrolysis of water, either acid or alkaline, to produce hydrogen and oxygen; the electrolysis of HCl to produce hydrogen and chlorine; and electro-organic processes such as the electrolytic reduction of benzene to cyclohexadiene or the electrolytic oxidation of toluene to an aldehyde. Electro-organic reactions are particularly favoured by a narrow gap anode-separator cathode configuration since electrolytes of low conductivity may be used without large voltage penalties.

It will be appreciated that with the described surface-activated particulate electrocatalysts a minimum amount of the expensive platinum-group metal electrocatalyst is distributed over the large surface area of the particles where substantially all of the electrocatalyst is exposed to the electrolyte and is therefore effective in the electrode reaction. Advantageously, the platinum-group metal content of the surface-activated particles will amount to between about 1–5% of the weight of the particle cores, although platinum-group metal contents as low as 0.2% will be feasible for some applications and contents as high as 15–20% will still show appreciable savings compared to particles composed entirely of the platinum-group metals or their oxides, or of alloys including the platinum-group metals. These surface-activated particles can thus be incorporated in a narrow gap electrolysis cell between the separator (diaphragm or membrane) and the current feeder grid in relatively large amounts providing a very high effective surface area of the catalyst for a relatively low loading of the expensive platinum-group metal. For example, particle loadings of from about 50–500 g/m$^2$, and usually about 100–300 g/m$^2$, on the separator surface may correspond to platinum-group metal loadings of the order of 2–20 g/m$^2$, so that the electrocatalyst is distributed over a very high effective surface area and occupies a relatively large volume. There is thus a much more effective use of the electrocatalyst and the effect of shielding or masking of the electrocatalyst by the separator and/or by the current feeder grid is minimized. Furthermore, operation at high current densities will be favoured, particularly when conductive particle cores are used. If desired, the surface-activated particles according to the invention can be mixed with fillers and extenders such as finely divided carbon and particulate PTFE, but this is not usually necessary or advantageous.

In the narrow gap cell of the invention, the saving in electrocatalytic material can be enhanced by combining the surface-activated powders with a current feeder grid or intermediate foil which has a surface-activated film, as previously described, containing about 0.2 to 2 g/m$^2$ of the platinum-group metal electrocatalyst, compared to the usual loadings of 6–12 g/m$^2$ for applied coatings.

BRIEF DESCRIPTION OF DRAWINGS

The FIGURE is a schematic cross-sectional view through the essential elements of an embodiment of a narrow gap electrolysis cell according to the invention.

BEST MODES FOR CARRYING OUT THE INVENTION

Figure 1:
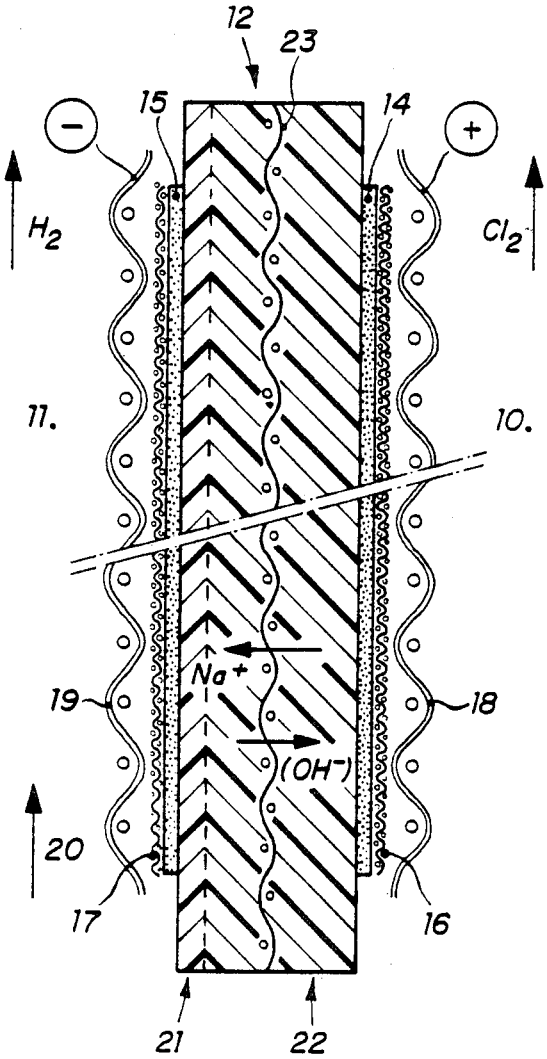

The FIGURE illustrates an embodiment of a narrow gap electrolysis cell in which an anode compartment 10 and a cathode compartment 11 are separated by a separator in the form of an ion-permeable solid-polymer membrane 12. On its opposite faces, the membrane 12 carries a particulate anode 14 and a particulate cathode 15 and is sandwiched between foraminate current collectors consisting of a fine mesh 16 and an expanded metal sheet 18 on the anode side and a fine mesh 17 and an expanded metal sheet 19 on the cathode side.

When the cell is used for brine electrolysis, the anode compartment 10 contains sodium chloride brine which is dissociated at the anode 14 to evolve chlorine gas, and sodium ions released in the anodic reaction migrate through the ion-permeable membrane 12 to the cathode 15. At the cathode 15, water is dissociated into hydrogen gas and hydroxyl ions which combine with the migrated sodium ions to form sodium hydroxide which is flushed away from the cathode area by a flow 20. However, part of the hydroxyl ions and/or sodium hydroxide tends to counter-migrate through the membrane from the cathode 15 to anode 14. This gives rise to undesired oxygen evolution which decreases the current efficiency of the cell.

To obtain a good compromise between maximum transfer of sodium ions towards the cathode 15 and minimum transfer of hydroxyl ions towards the anode 14, the membrane 12 may for example consist of a copolymeric perfluorocarbon such as NAFION (trademark) having on its cathodic side a relatively thin zone 21 containing pendant carbonyl based functional ion-exchange groups (which strongly inhibit hydroxyl ion back migration), and on its anodic side a relatively thick zone 22 containing pendant sulphonyl based ion-exchange functional groups.

The membrane 12 can be produced by any suitable methods such as extrusion, calendering and solution coating. Advantageously, the membrane 12 includes an internal reinforcing framework 23 such as a mesh of any suitable material, e.g. PTFE (Teflon, trademark). Layers 21 and 22 of copolymer containing different pendant functional groups can be laminated under heat and pressure in well known processes to produce a membrane having desired functional group properties at its opposite faces. For chlorine cells, such membranes usually have a thickness between 100 and 250$\mu$, although thicknesses from about 25 to about 3750$\mu$ are possible.

The particulate anode 14 and particulate cathode 15 are usually bonded to the membrane 12. One technique is to blend surface-activated anodic or cathodic particles with polytetrafluoroethylene particles; place a layer of the mixture onto the fine anode or cathode mesh 16 or 17 which has, if appropriate, been subjected to a surface-activation and/or coating with an electrocatalyst; apply heat and pressure until the mixture has sintered into a porous electrode; then press the mesh-/electrode assembly 16/14 or 17/15 onto the separator 12 with the application of heat to provide a firmly bonded membrane/electrode assembly incorporating the outer conductive fine meshes 16 and 17 for providing good contact with the current collectors 18,19.

Another technique for applying the particulate electrodes to the membrane 12 is to preform a sheet of the surface-activated particulate material e.g. by making a dispersion of the particles with a semi-conductive polymer precursor in a suitable solvent, for instance polyacrylonitrile in dimethylformamide and isopropylalcohol, placing the dispersion on a suitable support such as a foil of aluminum, drying and heat-treating to convert or partly convert the precursor to a semi-conductive polymer, this operation possibly being repeated by applying further layers of the dispersion until an electrode of desired thickness is built up. After removal of the support foil the particulate electrode is sandwiched between the fine mesh 16 or 17 and the membrane 12, and bonded by the application of heat and pressure.

Alternatively, the particulate electrode can be formed by applying the dispersion including the semi-conducting polymer precursor and the surface-activated particles directly to the fine mesh 16 or 17.

Similar techniques can be used for other polymeric binders including dispersions containing precursors of the ion-exchange copolymers of membrane 12. Also, if necessary or desirable, the dispersion can include pore formers such as zinc oxide or calcium carbonate for providing an adequate porosity of the electrode 14 or 15 to allow for good permeation by the electrolyte and to facilitate gas release.

Several examples of preparation of the surface-activated particulate materials incorporated in anode 14 and/or cathode 15 will now be given.

EXAMPLE I

Titanium powder with a particle size of 150–300 microns (50–100 mesh ASTM) is etched in 10% oxalic acid at 90° C. for 30 minutes, washed with distilled water, dried then wetted with a solution of 0.2 g $IrCl_3$ aq., 0.1 g $RuCl_3$ aq., 0.4 ml HCl (concentrated, 12N) and 6 ml ethanol. The powder is mixed in the solution in a ratio 1 g of powder to 1 ml of solution, excess solution drained off and the damp powder is slowly dried in air, in a two-stage drying, firstly at 50°–70° C. for 15 minutes then at 120° C. for 30 minutes. The dried powder is then heated at 350°–500° C. in a closed furnace for 30 minutes to produce an activated surface film of titanium oxide containing the iridium/ruthenium oxide electrocatalyst.

This activated powder can be incorporated in the cathode 15 or, preferably, the anode 14 typically with a loading of about 100–400 g/m$^2$ of the membrane surface area, corresponding to catalyst loadings of about 1.4–5.6 g/m$^2$ of iridium and about 0.6–2.4 g/m$^2$ of ruthenium.

EXAMPLE II

Sandblasted zirconium powder with a particle size of about 420 microns (40 mesh) is wetted with a solution of 0.5 g $RuCl_3$ aq., 0.4 ml HCl 12N and 6 ml ethanol and slowly dried following the same procedure as in Example I. This is followed by a heat-treatment at 320°–450° C. for 15 minutes in air, and the application, drying and heating procedure is repeated four times with a final prolonged heating at 320°–450° C. for 4 hours in air.

The surface-activated zirconium powder obtained is suitable for incorporation into the anode 14 typically with a loading of 50–300 g Zr/m$^2$ which corresponds to a loading of about 1.8–11 g/m$^2$ of ruthenium. Such a narrow gap cell anode is particularly suitable for oxygen evolution from an acid solution.

EXAMPLE III

Titanium powder is activated as in Example I firstly with an activating solution of 0.1 g $RuCl_3$ aq., 0.4 ml HCl 12N and 6 ml ethanol then with four further applications of an activating solution of 1.0 g $RuCl_3$ aq., 0.4 ml HCl 12N, 3 ml butyltitanate and 6 ml ethanol, with the same drying and heating after each coat.

The surface-activated particles obtained have a mixed-crystal coating of ruthenium oxide-titanium oxide. When these particles are included in the anode 14 with a loading of 50–150 g/m$^2$ there is a corresponding loading of about 4–12 g/m$^2$ of ruthenium.

EXAMPLE IV

Example III is repeated except that the second activation solution applied four times consists of 0.6 g $RuCl_3$ aq., 0.3 g $SnCl_2$ (anhydrous), 3 ml butyl titanate, 0.4 ml HCl and 6 ml butanol. The surface-activated particles obtained have a mixed-crystal coating of ruthenium oxide-tin oxide-titanium oxide. When these particles are included in the anode 14 with a loading of 50–250 g/m$^2$ there is a corresponding loading of about 2.4–12 g/m$^2$ of ruthenium.

EXAMPLE V

Example III is repeated except that the second activation solution applied four times contains 1.0 g of ruthenium and iridium chlorides in a 1:2 weight ratio. These surface-activated particles are advantageously included in the anode 14 of a cell for brine electrolysis or for water electrolysis as an oxygen-evolving electrode.

EXAMPLE VI

Titanium powder with a particle size of 400–450 microns is pretreated and activated as in Example I except that the activating solution consists of 1 g $H_2PtCl_6$, 0.5 g $IrCl_3$, 10 ml isopropylalcohol and 10 ml linalool and the heat treatment is carried out at 480° C. for 30 minutes in ammonia/butane.

The surface-activated powder obtained has a 70/30 platinum/iridium alloy on its surface and is suitable for incorporation in the anode 14 or cathode 15, with a loading of about 50–100 g/m$^2$ of titanium.

EXAMPLE VII

Sandblasted zirconium powder with a particle size of 105 to 840 microns is degreased and etched in warm aqua regia for about 30 minutes, washed with de-ionised water and dried at 60°–70° C. for 30 minutes. The powder is then placed on a horizontal cathode immersed in an electroplating bath composed of 7.5 KOH, 10 g $K_2Pt(OH)_6$ and 500 ml $H_2O$ at 75°–80° C., and an electrolysis current corresponding to 11 mA/cm$^2$ on the cathode passed for 12 minutes. The zirconium powder thus surface-activated with electroplated platinum is ideally suited for incorporation into the cathode 15; a loading of about 50–150 g/m$^2$ of the activated powder corresponds to a loading of about 5–15 g/m$^2$ of platinum.

EXAMPLE VIII

Titanium powder with a particle size of 200–400 microns is pretreated as in Example I, and activated with an activating solution consisting of 0.22 g Ir (as IrCl3 aq.), 0.040 g Ru (as RuCl3 aq.), 0.80 g polyacrylonitrile (PAN), 6 ml dimethylformamide (DMF) and 3 ml isopropylalcohol (IPA). The powder is immersed in the solution, excess solution drained off and the powder slowly dried and then heated at 250° C. for 15 minutes in an air flow of 60 l/h. This entire procedure is repeated four times in all and at the end of the final heat treatment the temperature is gradually raised to 450° C. during 15 minutes and held at 450° C. for 10 minutes in the same air flow of 60 l/h.

The surface-activated titanium particles obtained in this manner have iridium and ruthenium oxides finely divided in a semi-conducting polymer on the particle cores. These particles can be incorporated in the anode 14 or cathode 15, possibly in amounts of 300–900 g/m$^2$ of Ti which corresponds to a loading of 0.8–2.4 g/m$^2$ Ir, 1.5–4.5 g/m$^2$ Ru and 1.6–4.8 g/m$^2$PAN.

EXAMPLE IX

Prior to or during incorporation in the anode 14 or cathode 15, the surface-activated powders of Examples I-VIII may be mixed with the usual extenders and binders such as finely-divided carbon or graphite (usually in a very small quantity) and PTFE, and also with suitable amounts of other electrochemically-active powders which either promote the wanted reaction or inhibit an unwanted reaction. For example, the cathode 15 may contain a mixture of the surface-activated powder and nickel powder, or the anode 14 may contain a mixture of the surface-activated powder and a powdered oxygen-evolution poison such as a finely divided tin dioxide-bismuth trioxide solid solution, e.g. 85–95% by weight of the surface-activated particles and 5–15% of the $SnO_2.Bi_2O_3$ solid solution with a Sn:Bi weight ratio of about 4:1.

SECOND EMBODIMENTS

In a second embodiment of narrow gap electrolysis cell according to the invention, the separator is composed of a mat of fibres, as illustrated by the following Examples.

EXAMPLE X

A substantially dimensionally-stable polymer-modified asbestos diaphragm is applied to a cathode can of a convention diaphragm chloralkali cell using the method described in UK Patent No. 1 410 313. The cathode can typically has a steel screen or mesh on its opposite faces. The outer surfaces of the screens may advantageously carry a porous electrocatalytic coating such as melt-sprayed particulate nickel or cobalt or a mixture thereof. Such a coating may be applied as described in U.S. Pat. No. 4,024,044 by melt-spraying the particulate nickel and/or cobalt in admixture with aluminium and then leaching out the aluminium. Alternatively, and preferably, surface-activated particles according to the invention, such as those described in Examples VI or VII may be applied to the outer surface of the screens by application of a dispersion of the surface-activated particles with a suitable binder such as a precursor of a semi-conducting polymer on an ion-conducting polymer.

A dispersion is prepared of conventional asbestos fibres (usually crysotile asbestos of empirical formula 3 $Mg0.2SiO_2$. $H_2O$ and usually with a fibre length from about 0.5 mm to 400 mm and a diameter from about 0.01 u to about 20$\mu$, typically from about 0.015$\mu$ to 0.03$\mu$) with various chemically and mechanically resistant thermoplastic fibres in a cell liquor typically containing about 15% NaOH and about 15% NaCl with a suitable surfactant. The dispersion is mixed to obtain a uniform slurry. Suitable thermoplastic fibres include various polyfluorocarbons such as poly(vinyl fluoride), poly(-vinylidenefluoride), polytetrafluorethylene (PTFE), and polyperfluoroethylene propylene. Also useful are chlorinated resins such as poly(vinylidene chloride) and chloro-fluoro materials such as polychlorotrifluoroethylene and polychlorotrifluoroethylene copolymers. PTFE, e.g. as available under the trademark TEFLON is preferred.

The mixture is applied to the can by immersing the can in the slurry and applying vacuum, e.g. by applying a low vacuum (about 0–6 cm, Hg gauge) for 5 minutes, followed by full vacuum (about 70 cm) for 10 minutes. Then, according to the conventional technique, the coated cathode can is removed, subjected to full vacuum for about half an hour, dried at about 95° C. for about 1 hour and heated to fuse the polymer, e.g. at about 370° C. for 1 hour when PTFE fibres are used. The quantity of polymer is chosen such that it incompletely covers the asbestos fibres, but binds the asbestos fibres together to provide a dimensionally stable diaphragm.

According to the invention, prior to the final drying and/or heating step, a further layer of surface-activated asbestos fibres is deposited. The surface-activated asbestos fibres may be prepared by immersing the fibres in a solution of polyacrylonitrile (PAN) and dimethyl formamide (DMF), draining off the excess solution followed by drying of the fibres and heating to about 250° C. for about 15 minutes to provide a semi-conducting layer of PAN. The fibres are then activated by the application of four coatings using the second activating solution of Example III and the same procedure with the difference that after application of the fourth coat, the wet fibres are applied as a dispersion to the outer face of the diaphragm on the cathode can. The fibres are then dried and this is followed by a final heat treatment at about 370° C. for 1 hour to finish baking of the catalytic coating and simultaneously fuse the polymer in the diaphragm.

A composite dimensionally-stable surface-activated diaphragm is thus provided with a base diaphragm layer bonded to a conductive and catalytically active outer layer formed by the surface-activated fibres.

In a narrow gap cell with such a composite diaphragm, an expandable anode of the type described in U.S. Pat. No. 3 674 676 is employed and the foraminate surface of the anode is brought into contact with the surface-activated fibres on the diaphragm. Thus the conventional diaphragm-anode spacing of about 6–15 mm is eliminated with a consequential voltage saving.

EXAMPLE XI

A dimensionally-stable diaphragm containing PTFE in the asbestos fibres is vacuum deposited as described above. Prior to the final drying and/or heating of the diaphragm, an activating solution consisting of 1 g $RuCl_3$ aq. in 6 ml ethanol with a uniform dispersion of 0.006 g of finely divided graphite powder is applied by brush in four layers with drying of each layer, followed by a heat treatment of 370°–450° C. for 1 hour in air. This heat treatment fuses the PTFE in the diaphragm and converts the $RuCl_3$ to a coating of $RuO_2$ on the outer fibres of PTFE-bonded asbestos forming the diaphragm.

EXAMPLE XII

Examples X and XI may be modified by forming the diaphragm with an ion-exchange resin as the thermoplastic fibres, examples being the polymeric, perfluorinated sulphuric acid ion-exchange resin sold under the trademark XR of Du Pont (as used in U.S. Pat. No. 3,853,720), as well as NAFION (trademark) polymers. Another example is the cation exchanger poly(perfluoroethylene-trifluoroethylene sulphuric acid) applied on asbestos as described in Dutch published Patent Application No. 72/12225. These ion-exchange resins may partly or fully cover the asbestos fibres.

It is also impossible to include an ion-exchange resin in the activating solution used for the outer layer of asbestos fibres.

EXAMPLE XIII

Instead of forming the asbestos-based diaphragm in situ by the described vacuum technique, the polymer reinforced diaphragm can be formed as a sheet, e.g. following the teaching and examples of U.S. Pat. No. 4 070 257.

When the fibrous diaphragm is formed as a sheet, the surfaces may be activated by applying an activating solution as in Example XI, or coated asbestos fibres may be applied as in Example X, or a particulate anode and/or cathode can be applied in the manners described in relation to FIG. 1 and exemplified by Examples I-IX.

EXAMPLE XIV

A diaphragm can be also formed principally of thermoplastic polymeric fibres, for example following the teachings of U.S. Pat. Nos. 4,036,729, 4,126,536 and 4,138,314.

These diaphragms can then be converted according to the invention by applying at least one layer of fibres of the same thermoplastic material with a platinum-group metal or oxide surface coating, or a layer of different fibres with a catalytic surface coating or layer of surface-activated particles e.g. a powder, as illustrated below.

Using the vacuum technique generally as described above, a first layer of very fine fibres of a copolymer of chlorotrifluoroethylene and vinylidene fluoride (25:1 ratio) is deposited on a cathode can, followed by a second layer of the same fibres mixed with a predominant amount of surface-activated titanium or titanium dioxide particles having a particle size of 0.5–5 microns. The paticles are surface-activated e.g. as in Examples I–VIII. The thus formed diaphragm is then dried and used as a narrow gap electrolysis cell with an expandable anode applied against the outer surface-activated layer of the diaphragm.

EXAMPLE XV

A diaphragm can also be formed of fibres of an ion-exchange polymer. For example, fibres of NAFION (trademark) are applied to a cathode can by vacuum deposition from a slurry.

Further NAFION fibres are wetted with a solution of 0.5 g $RuCl_3$ aq. in 6 ml ethanol, excess solution is drained off and the fibres dried, this coating procedure being repeated four times. The coated fibres are then applied as a dispersion to the outer face of the diaphragm on the cathode can, either by painting or by vacuum deposition. The fibres are then dried and this is followed by a final heat treatment at 320° C. for about 1 hour in air to convert the $RuCl_3$ to a ruthenium dioxide coating on the outer NAFION fibres, and to partly fuse the fibres together to make the separator substantially impervious. Impermeability is maintained and improved when pressure is applied during use by an expandable anode pressing against the surface-activated fibres. Advantageously, pore formers can be included with the surface-activated fibres, to improve electrolyte-permeability to the catalyst and assist gas release.

A composite separator formed in this way behaves as a substantially electrolyte-impervious but ion-permeable membrane. The described procedure can thus be used to retrofit existing diaphragm cells to narrow gap membrane cells. Formation of the composite membrane substantially as described is very advantageous and provides a rugged membrane which withstands the cell conditions better than preformed membranes, and avoids the difficulties of supporting the preformed membranes. Also, in use of the cell, the surface-activated electrocatalytic membrane layer will protect the fibres of the underlying membrane from deposits (such as Ca and Mg) due to a high pH in the electrolyte. Such deposits will instead deposit on the electrocatalytic layer which can be regenerated periodically.

Many variations of this Example are possible. The surface-activated fibres can simply be pressed against the predeposited ion-exchange fibres i.e. without sufficient heat to fuse the fibres, so that the fibrous separator is held together by the pressure applied by the expandable anode. Alternatively, the surface-activated fibres can be applied to the predeposited ion-exchange fibres in a dispersion of e.g. NAFION in a suitable solvent such as 1, 1, 2-trichlorotrifluorethane (FREON 113, trademark), possibly with a pore former. After evaporation of the solvent, the NAFION dispersion can be fused onto the predeposited fibres at a temperature of about 275° C. for about 30 minutes.

We claim:

1. A narrow gap electrolysis cell having anode and cathode compartments divided by an ionically-permeable separator, the anode and cathode compartment containing an anode and a cathode at least one of which comprises a current feeder grid in electrical contact with a particulate electrocatalytic material carried on a face of said separator as an integral part thereof, said particulate electrocatalytic material comprising surface-activated particles having a core of corrosion-resistant non-precious material and an outer surface containing at least one platinum-group metal electrocatalyst in metal and/or oxide form.

2. The electrolysis cell of claim 1, wherein the corrosion-resistant nonprecious material of the particle cores consists essentially of a valve metal or a valve metal compound.

3. The electrolysis cell of claim 1, wherein the particles comprise a core of valve metal having an integral surface film of a compound of the valve metal incorporating the platinum-group metal electrocatalyst.

4. The electrolysis cell of claim 3, wherein the surface film of the valve metal particles consists of oxide.

5. The electrolysis cell of claim 3, wherein the surface film of the valve metal particles consists of carbide, nitride, hydride or boride.

6. The electrolysis cell of claim 1 or 3, wherein the particles are coated with a codeposited mixed crystal of at least one platinum-group metal oxide and at least one valve metal oxide.

7. The electrolysis cell of claim 1, wherein the particles are coated with a semi-conducting polymer in which the platinum-group metal electrocatalyst is dispersed.

8. The electrolysis cell claim 1, wherein said platinum-group metal electrocatalyst amounts to 0.2–15%, preferably 1–5% by weight of the core material.

9. The electrolysis cell of claim 8, wherein the surface-activated particles are carried on the face of said separator in an amount of from about 50–500 g/m$^2$ of the separator surface and said particles include platinum-group metal in an amount of about 2–20 g/m$^2$.

10. The electrolysis cell of claim 1, 8 or 9 wherein said surface-activated particles have a size range between about 20 and 200 mesh.

11. The electrolysis cell claim 1, wherein the current feeder grid is composed of valve metal having, at least on its surface facing the separator, an integral electrocatalytic and electroconductive surface film of a compound of the valve metal containing a platinum-group metal electrocatalyst in metal and/or oxide form.

12. The electrolysis cell claim 1, wherein some electrocatalytic particles are also carried by a flexible porous foil of electronically-conductive material disposed between the current-feeder grid and the separator, the current feeder grid being a relatively rigid structure with relatively large openings compared to the porous foil.

13. The electrolysis cell of claim 12, wherein said flexible porous foil is a foil of valve metal having an integral electrocatalytic and electroconductive surface film of a compound of the valve metal containing a platinum-group metal electrocatalyst in metal and/or oxide form.

14. The electrolysis cell claim 1, wherein the separator is a hydraulically impermeable ion-exchange membrane.

15. The electrolysis cell of claim 1, wherein the separator is composed of a mat of fibres.

16. The electrolysis cell of claim 15, wherein the separator comprises asbestos fibres.

17. The electrolysis cell of claim 15, wherein the separator comprises fibres of a hydraulically impermeable ion-exchange material.

18. The electrolysis cell of claim 15, 16 or 17 wherein the corrosion-resistant non-precious material forming the core of said surface-activated particles comprises fibers in the face of said separator, which, except for the platinum-group electrocatalyst thereon, are of the same type as those in the main body of said separator.

19. The electrolysis cell of claim 1, wherein the current feeder grid has on its surface a corrosion-resistant conductive material having an overvoltage which is higher than the overvoltage of the electrocatalyst on the particles whereby the grid surface does not participate in the desired electrochemical reaction in the cell.

20. The electrolysis cell of claim 1, wherein the current feeder grid and the surface activated particles are both coated with the same or an electrocatalytically similar material whereby both grid surface and the surface-activated particles participate in the desired electrochemical reaction in the cell.

21. A narrow gap electrolysis cell divided into anode and cathode compartments by an ionically-permeable separator, said anode compartment containing an anode comprising a current feeder grid in electrical contact with particulate electrocatalytic material carried on the anode-side face of said separator as an integral part thereof, said particulate electrocatalytic material comprising surface-activated particles having a core of corrosion-resistant non-precious material and an outer surface containing at least one platinum-group metal electrocatalyst in metal and/or oxide form, and said cathode compartment containing an oxygen cathode in contact with the cathode side of said separator and including means for supplying an oxygen-containing gas to said oxygen cathode.

* * * * *